US010287740B2

(12) United States Patent
Knezevich et al.

(10) Patent No.: US 10,287,740 B2
(45) **Date of Patent: *May 14, 2019**

(54) FLOOD BARRIER SYSTEM

(71) Applicant: Neptune Systems, LLC, Pompano Beach, FL (US)

(72) Inventors: John William Knezevich, Ft. Lauderdale, FL (US); Guy Richard Hamilton, Coral Gables, FL (US); Joseph Michael Davis, Jr., Newnan, GA (US)

(73) Assignee: Neptune Systems, LLC, Pompano Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/485,994

(22) Filed: Apr. 12, 2017

(65) Prior Publication Data

US 2017/0218586 A1 Aug. 3, 2017

Related U.S. Application Data

(63) Continuation of application No. 15/146,450, filed on May 4, 2016, now Pat. No. 9,670,634, which is a (Continued)

(51) Int. Cl.
*E02B 3/10* (2006.01)
*E04H 9/14* (2006.01)
(Continued)

(52) U.S. Cl.
CPC ..... *E02B 3/106* (2013.01); *E02B 3/102* (2013.01); *E02B 7/22* (2013.01); *E02B 7/54* (2013.01);
(Continued)

(58) Field of Classification Search
USPC ..... 405/114
See application file for complete search history.

(56) References Cited

U.S. PATENT DOCUMENTS 4,439,061 A 3/1984 Whipps
4,582,451 A 4/1986 Hollander, Jr.
(Continued)

FOREIGN PATENT DOCUMENTS

DE 3429190 A1 2/1986
DE 19649868 A1 6/1997
(Continued)

OTHER PUBLICATIONS

Young, Lee W., International Search Report dated Aug. 13, 2015, for International Patent Application No. PCT/US2015/11790, 5 pgs.

*Primary Examiner* — Kyle Armstrong
(74) *Attorney, Agent, or Firm* — Richard P. Gilly, Esquire; Archer & Greiner, P.C.

(57) ABSTRACT

A flood barrier system includes vertical elements and panels extending between such vertical elements, the foregoing components having various features for inhibiting passage of flood water therethrough. One or more vertical elements may have a multi-layer base plate which forms a watertight seal with vertical gaskets disposed on the vertical elements. One of the vertical elements of the system may comprise a stanchion post which may be formed of extruded aluminum. Another vertical element which may find potential use in certain applications may be secured to a store front mullion. The panels in such system may include specially adapted gaskets to reduce instances of leakage. The vertical elements and panels allow the present flood barrier system to be flexible and readily deployable as a barrier to flood or flood risk.

12 Claims, 8 Drawing Sheets

Related U.S. Application Data continuation of application No. 14/162,317, filed on Jan. 23, 2014, now Pat. No. 9,376,778.

(51) Int. Cl.

| | |
|---|---|
| ***E02B 7/22*** | (2006.01) |
| ***E02B 7/54*** | (2006.01) |
| ***E06B 9/02*** | (2006.01) |
| *E06B 9/00* | (2006.01) |

(52) U.S. Cl.

CPC ..... *E04H 9/145* (2013.01); *E06B 9/02* (2013.01); *E06B 2009/007* (2013.01)

(56) References Cited

U.S. PATENT DOCUMENTS

| | | | | |
|---|---|---|---|---|
| 4,685,261 | A | 8/1987 | Seaquist | |
| 4,841,696 | A | 6/1989 | Miller | |
| 4,934,868 | A | 6/1990 | Hellstrom et al. | |
| 5,439,316 | A | 8/1995 | Richardson | |
| 5,460,462 | A | 10/1995 | Regan | |
| 5,477,646 | A * | 12/1995 | Dietz | E06B 9/02 49/61 |
| 6,334,736 | B1 | 1/2002 | Johnson et al. | |
| 6,884,002 | B1 * | 4/2005 | Fuller | E02B 7/22 405/114 |
| 7,523,589 | B1 | 4/2009 | Smith | |
| 7,546,710 | B2 | 6/2009 | Abbott | |
| 7,552,565 | B1 | 6/2009 | Smith | |
| 7,815,397 | B1 | 10/2010 | Dung | |
| 8,001,735 | B2 | 8/2011 | Fisher | |
| 8,245,461 | B2 | 8/2012 | Wei | |
| 8,613,171 | B2 | 12/2013 | Dudash | |
| 9,453,316 | B1 * | 9/2016 | Cadogan | E02B 3/102 |
| 2003/0159376 | A1 * | 8/2003 | Huynh | E04H 9/04 52/208 |
| 2005/0284038 | A1 | 12/2005 | Jenkins | |
| 2009/0252557 | A1 * | 10/2009 | Fisher | E06B 9/02 405/107 |
| 2013/0272794 | A1 | 10/2013 | Osborne | |

FOREIGN PATENT DOCUMENTS

| | | | |
|---|---|---|---|
| DE | 20 2004 012 013 | U1 | 2/2005 |
| DE | 10 2006 055 031 | A1 | 5/2008 |
| EP | 0627529 | A1 | 12/1994 |
| EP | 2333162 | A1 | 6/2011 |
| WO | 2013119491 | A1 | 8/2013 |
| WO | 2014003051 | A1 | 1/2014 |

* cited by examiner

FLOOD BARRIER SYSTEM

FIELD

This disclosure relates to systems for protecting structures from floodwater, and more particularly, to a "stop-log" system which is selectively deployable in response to flood or flood risk.

BACKGROUND

Multi-panel flood barrier systems, also referred to as "stop log" systems, are known in the art, and are used to protect structures against flooding. Current systems may suffer from various drawbacks and disadvantages. For example, in many situations, such flood barrier systems need to be deployed relatively quickly, yet the various components of such systems may not be well adapted to quick installation for any number of reasons, ranging from being excessively heavy, complex, manual-labor intensive, or simply not being versatile enough to conform to the particular requirements of the structure to be protected. Whatever the system, it is likewise important for these systems to have as little "leaking" as possible and to otherwise be effective at preventing flood water from infiltrating past them and coming into contact with the building to be protected.

The foregoing potential drawbacks are often a function of the lengths of the barriers being installed, so any such drawbacks and installation inefficiencies are only magnified as the distance a stop log barrier is deployed increases, such as occurs over multiple courses of stop logs or in multiple locations. As such, seemingly insignificant installation steps, weight, inflexibility, or other limitations become multiplied, thus compounding delays and complexity many times over.

Efforts to simplify floor barrier systems are often hampered by the need for such systems to be effective at keeping out flood waters. For example, when multiple components are deployed in anticipation of a flood, such components need to be sealed in such a way that they not only conform to the topography of the opening or structure to be protected, but that they resist leakage at critical junctions at or between components of the flood barrier system.

SUMMARY

A flood barrier system of the present disclosure protects a structure from flood water, by making use of multiple, "stop log" type, panels stacked atop each other between corresponding vertical elements. In certain implementations, one or more of the vertical elements has a base plate at its bottom end, and a pair of gaskets extending vertically along such element. At least one of such vertical gaskets engages the base plate in an interference fit at its lower end and thus seals the bottom element in a watertight manner.

In some implementations, the panels have panel gaskets along their bottom edges, and such gaskets are designed to remain between opposing faces of the panels when they are vertically compressed as part of the deployment of the vertical system.

In other implementations of this disclosure, a flood barrier system includes multiple, vertical elements adapted to engage the panels, and a base plate comprised of multiple layers at the lower ends of the vertical elements. In one possible implementation, the multiple layers of the base plate comprise three layers, including a structural plate and then first and second base-plate gaskets on either side of such structural plate. The upper base-plate gasket is interposed between the structural plate and a bottom portion of the vertical element to form a seal therebetween, whereas the lower base plate gasket forms a seal between the bottom of the base plate and the foundation or ground to which the corresponding vertical element is secured.

In still other implementations of this disclosure, multiple vertical elements are provided to engage the series of stacked panels, and one of the vertical elements is a stanchion post. The stanchion post is formed substantially of extruded aluminum.

DETAILED DESCRIPTION

Figure 1:
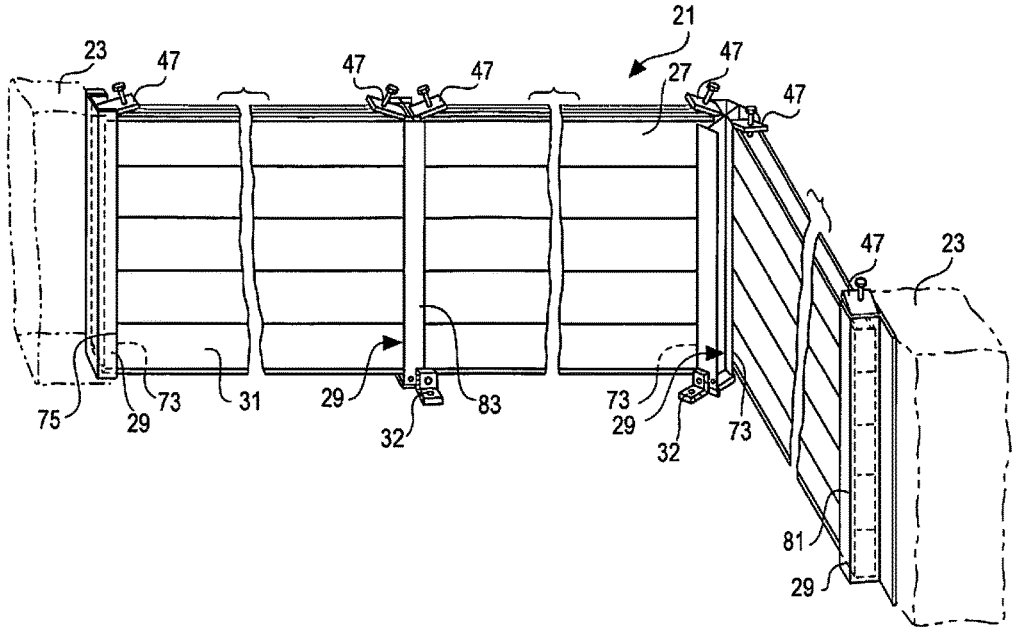
FIG. 1 is the perspective view of one of many possible implementations of a flood barrier system of the present disclosure for protecting a structure from then inflow of flood water.

Referring now to the drawings, and in particular to FIGS. 1-4, one of many possible implementations of a flood barrier system 21 accordingly to the present disclosure is generally shown. Exemplary flood barrier system 21 is selectively deployable to protect a structure 23 from the inflow of flood water 25. In one version, system 21 is deployable in response to flood or flood risk by stacking multiple "stop log" panels 27 atop each other between corresponding vertical elements 29, in which vertical elements 29 can assume any of a variety of forms as detailed subsequently herein.

Vertical elements 29 are adapted to receive corresponding ends of panels 27 in a watertight manner as detailed subsequently. As such, vertical elements 29 cause panels 27 to present forward faces 31 on the "wet side", that is, oriented toward the anticipated or actual encroachment of flood water, and rear faces 33 opposite forward faces 31, on the "dry side." As such, the combination of vertical elements 29 and panels 27 form, in this implementation, a temporary barrier to flood water 25.

According to one implementation, at least one of the vertical elements 29 has a base plate 37 secured thereto at a bottom end of such vertical element. Base plate 37, as discussed in more detail subsequently, may be suitably shaped and sized to underlie the horizontal foot-print of the vertical element 29 with which base plate 37 is associated.

Figure 3:
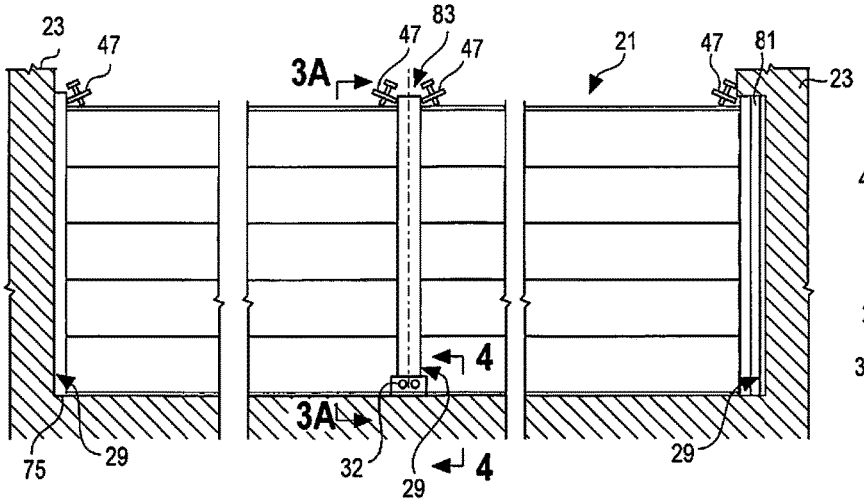
Figure 3A:
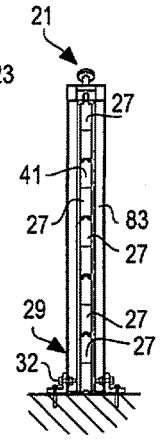
FIG. 3A is an enlarged sectional view taken along line 3A-3A of FIG. 3.
Figure 5:
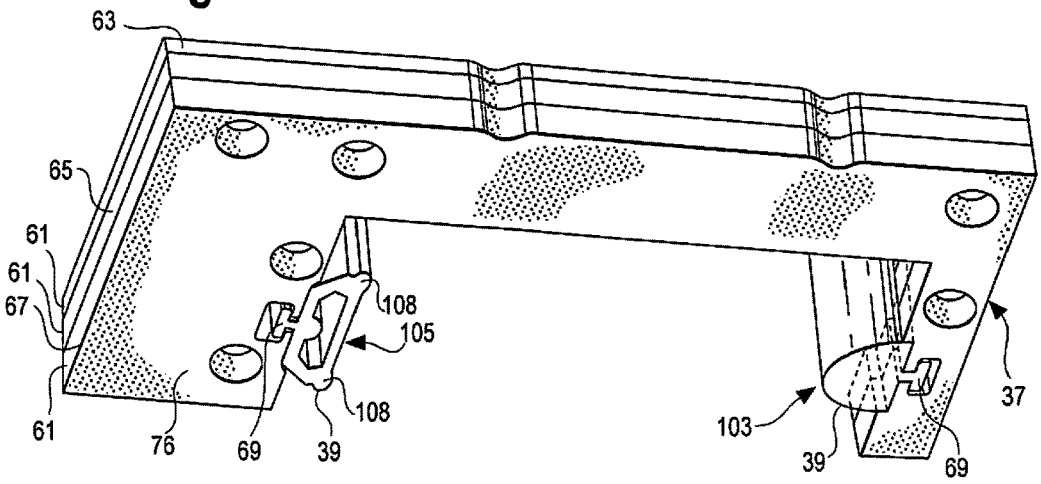
FIGS. 5 and 6 are isometric views of certain components of a flood barrier system in an implementation according to the present disclosure.
Figure 6:
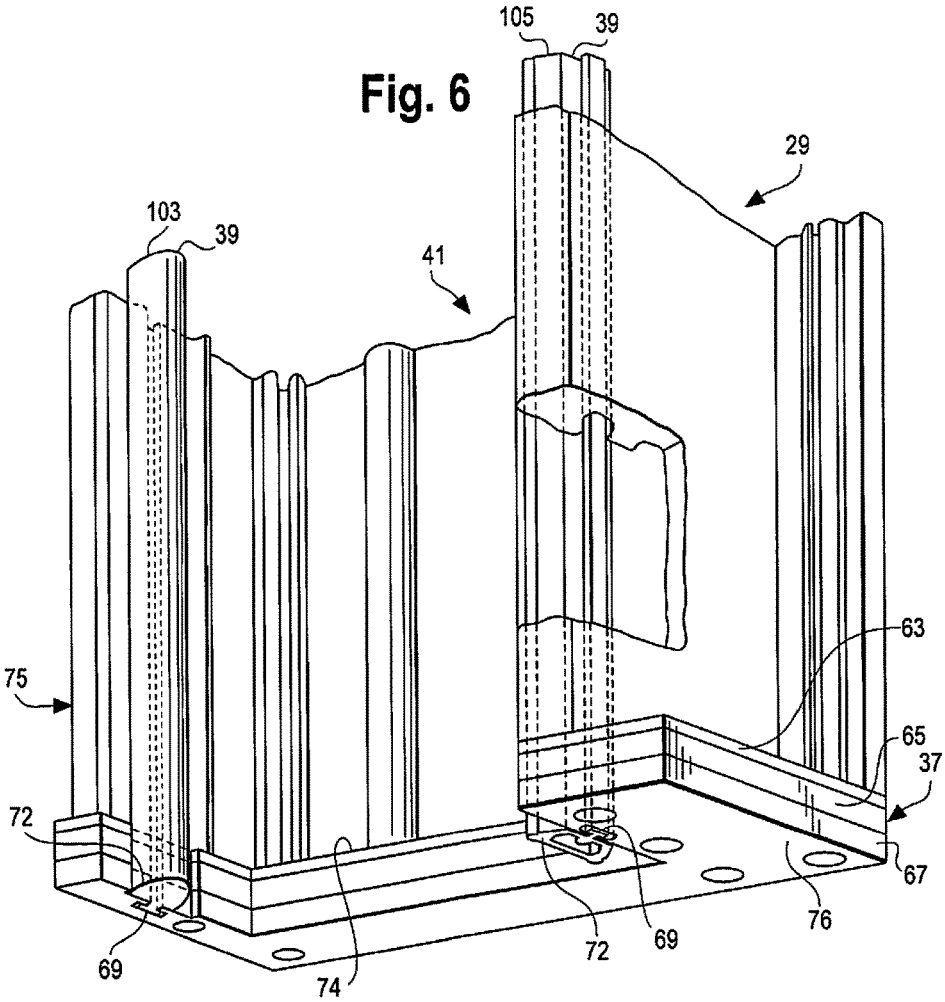

Referring now to FIGS. 3A, 5 and 6, the illustrated vertical element 29 includes first and second, vertically extending gaskets 39. Such vertical gaskets 39 are spaced from each other to engage respective opposite panel faces 31, 33 upon placement of panels 27 between gaskets 39. In the illustrated implementation, gaskets 39 are positioned to substantially oppose each other on opposite arms of a U-shaped channel or track 41.

Vertical gaskets 39 have lower ends which engage base plate 37 in an interference fit. The interference fit between lower ends of gaskets 39 and base plate 37 may be accomplished in a number of suitable ways, depending on the implementation. In the implementation illustrated in FIGS. 5 and 6, for example, gaskets 39 oppose vertical sides of base plate 37 in an interference fit. Gasket ends 72 extend through base plate 37 and are substantially co-planar with lower surface 76 of base plate 37. In this way, vertical gaskets 39 form an interference fit against the ground when base plate 37 is secured thereto. In other implementations, however, gaskets 39 need not extend through base-plate 37 and may form an interference fit with a top surface of base plate 37 including having gasket end 72 abut top surface 74 or another corresponding location on base plate 37. The various engagements between vertical gasket 39 and base plate 37 as described herein form a seal between the bottom end of the corresponding vertical element 29 and a corresponding location on base plate 37, or, viewed more generally, a seal is formed at the bottom corner of system 21 where vertical elements 29 are in contact with the ground and a corresponding panel 27.

Referring now more particularly to FIGS. 5 and 6, base plate 37 may include multiple layers of varying materials and comprise a composite baseplate to enhance the overall effectiveness of system 21. The layers may have outer edges which are substantially congruent with each other, but other variations and positioning of layers of the composite base plate may likewise be suitable for certain applications. In one possible implementation, multi-layer or composite base plate 37 includes a structural plate 65 and at least one base plate gasket 63, in this case disposed on the upper surface of structural plate 65. Gasket 63 has suitable compressive and water-resistant characteristics such that when base plate 37 is secured to the bottom end of vertical element 41, as seen in FIG. 6, upper base plate gasket 63 seals against opposing surfaces at the bottom end of vertical element 29 in a watertight manner. In the illustrated implementation, base plate 37 is secured at the bottom end of a suitable one of the vertical elements 29 by screws (not shown) extending from the bottom of base plate 37 into corresponding areas formed in the bottom end of vertical element 29. Other methods of securing base plate 37 to vertical element 29 are, of course, suitable and possible.

Base plate 37, in the illustrated implementation, includes a second base plate gasket 67 secured by any suitable means to the lower surface of structural plate 65. This second, lower base plate gasket 67 is of a suitable compressible material so that when vertical elements 29 are secured to the ground, such as by L-brackets 32 (FIG. 1-4), base plate gasket 67 contributes to the formation of a watertight seal between the ground and the structure 21. The durometer of compressible base plate gaskets 63, 67 may have a wide range depending on the many and varied applications of flood barrier system 21.

Figure 8:
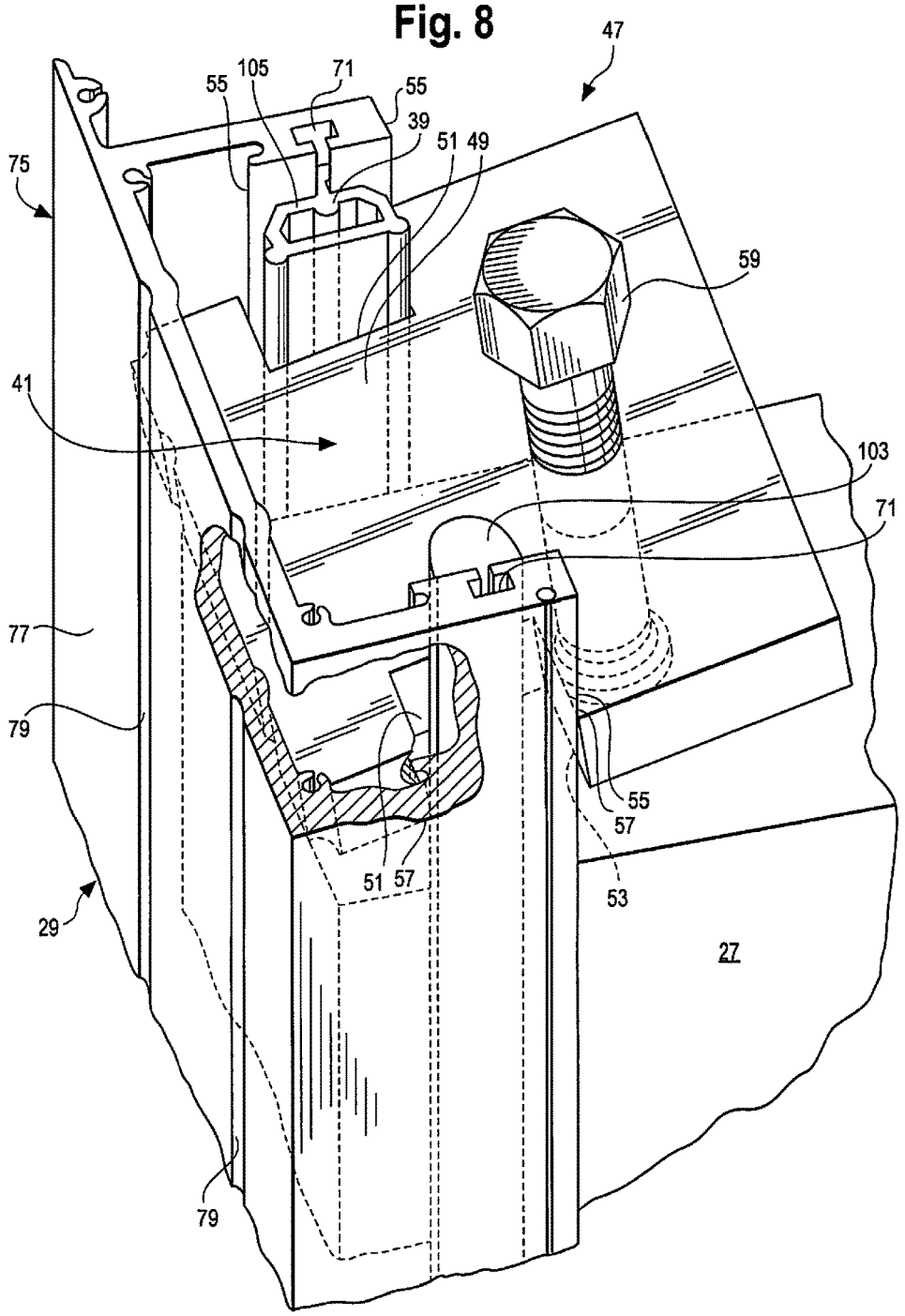
FIG. 8 is an isometric view of further components of implementations of the disclosed flood barrier system.

Base plate 37 may include one or more notches 69 located and configured to match the profile of corresponding receiving channels or receptors 71 extending vertically through vertical elements 29 (FIG. 8, 9). In one possible implementation, vertical gaskets 39 may be extended from the uppermost end of channel 41 down through the bottom edge of the corresponding vertical elements 29 and through notches 69 in base plate 37, in this implementation extending from the upper surface of base plate 37 all the way through to its bottom surface 76, extending through all three layers. As such, in the illustrated implementation, vertical gaskets 39 have bottom surfaces 72 located to engage the ground when the base plate 37 and corresponding vertical elements are secured thereto.

It will be appreciated that vertical gaskets 39 need not extend completely through base plate 37. For example, vertical gasket 39 may stop short of the ground and simply engage one or more portions of base plate 37 in an interference fit. The interference fit between corresponding portions of vertical gaskets 39 and base plate 37 may be such as to form a watertight seal there and enhance the effectiveness of system 21 thereby.

Vertical gaskets 39 may not only be positioned in an interference fit with base plate 37, but may also be secured thereto in any of a variety of ways, all within the scope of the present disclosure. For example, gaskets 39 may be heat-treated or chemically treated so as to connect to any one of the layers or locations of base plate 37. Opposing portions of base plate 37 may likewise be treated. In one implementation, for example, adhesive is used between opposing portions of gaskets 39 and base plate 37. In still other implementations vertical gaskets 39 are fused by any suitable means to one or more gasket layers of base plate 37, including upper base plate gasket 63 or lower base plate gasket 37, or both gaskets 63 and 67. The gaskets 39, 63, 67 may likewise be rearranged and integrated with each other either prior to being brought into operative proximity to vertical elements 29 or during deployment of the system 21. Regardless of when and how secured relative to each other, or relying simply on interference fit between gaskets 39 and base plate 37, the resulting arrangement may be designed to increase the resistance of the bottom corners 73 (FIGS. 1-4) to leakage of flood water thereto.

Figure 4:
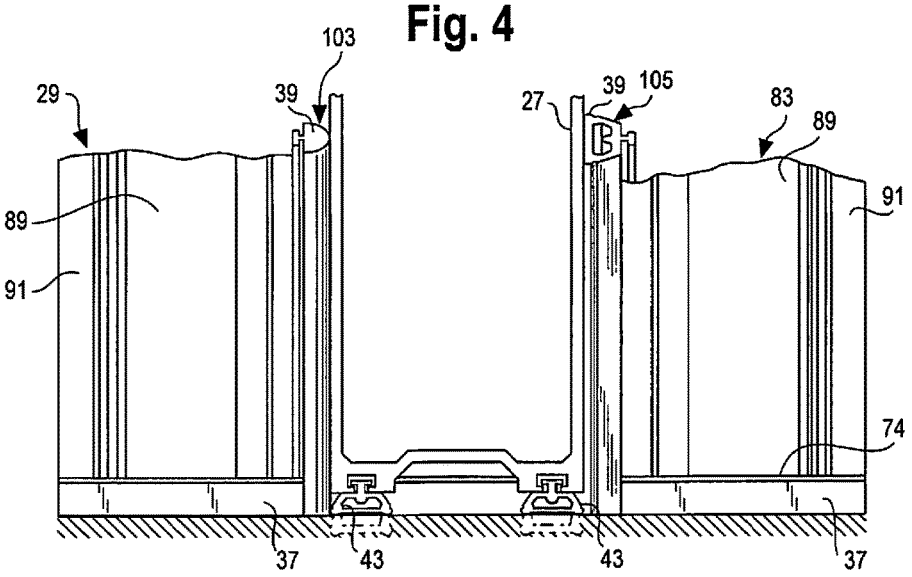
Figure 23:
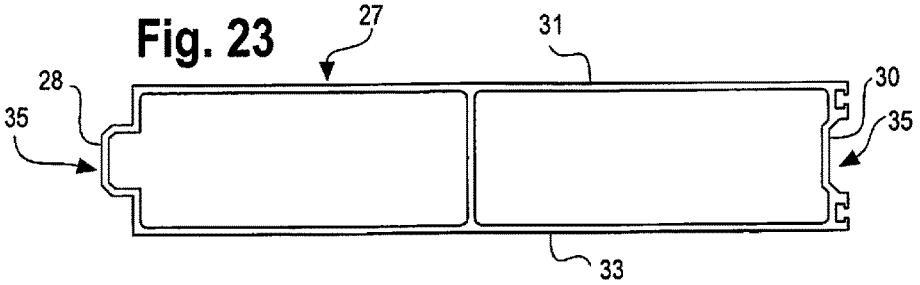
FIG. 23 is a cross-section of one exemplary implementation of a panel of flood barrier systems of the present invention.

Panels 27 have respective edges 35 between faces 31, 33 of panels 27. Edges 35 may be suitably configured so that when a bottom edge of one panel opposes the top edge of another panel as shown in FIGS. 1-4, the opposing panel edges have complimentary surfaces, such as tongues 28 and grooves 30 (FIG. 23), or otherwise nest or nestle within each other (FIG. 4). Referring now to FIG. 3A, in one possible implementation, the stop log panels 27 may be equipped with at least one panel gasket 43, in this case a pair of gaskets 43, which gaskets have surfaces engaging an opposing edge of an adjacent panel (or, in the case of the bottom-most panel, the ground). Gaskets 43 are configured to remain substantially between opposite forward and rear faces 31, 33 of the corresponding panel 27 upon vertical compression of such panel associated with deployment of the flood barrier system as explained subsequently. By configuring panel 27 to have panel gasket 43 remain substantially within the boundaries defined opposite panel faces, the panel gasket 43 avoids impinging upon or otherwise exerting force on adjacent vertical gaskets 39, which may otherwise create a potential opening for water to penetrate upon deployment of the system against flood water.

Vertical elements 29 are configured to receive opposite ends of panels 27 atop each other so that panels 27 extend between corresponding vertical elements 29, as shown generally in FIGS. 1-4. The receiving portions of vertical elements 29 may assume any of a variety of suitable configurations for engaging panels 27 received therein, such receiving configurations generally including channels, and one exemplary such channel being shown in FIG. 6 as channel 41, defined by three walls in a "C" configuration. Vertical gaskets 39 may be suitably adhered to portions of vertical elements 29 in any number of suitable ways, in the illustrated implementation being mounted in slots or receptors formed and extending vertically in elements 29. Two of the gaskets 39 may be disposed in spaced, opposing relationship to each other sufficient to receive panels 27 snuggly between opposing surfaces of gaskets 39 (FIG. 8).

Figure 9:
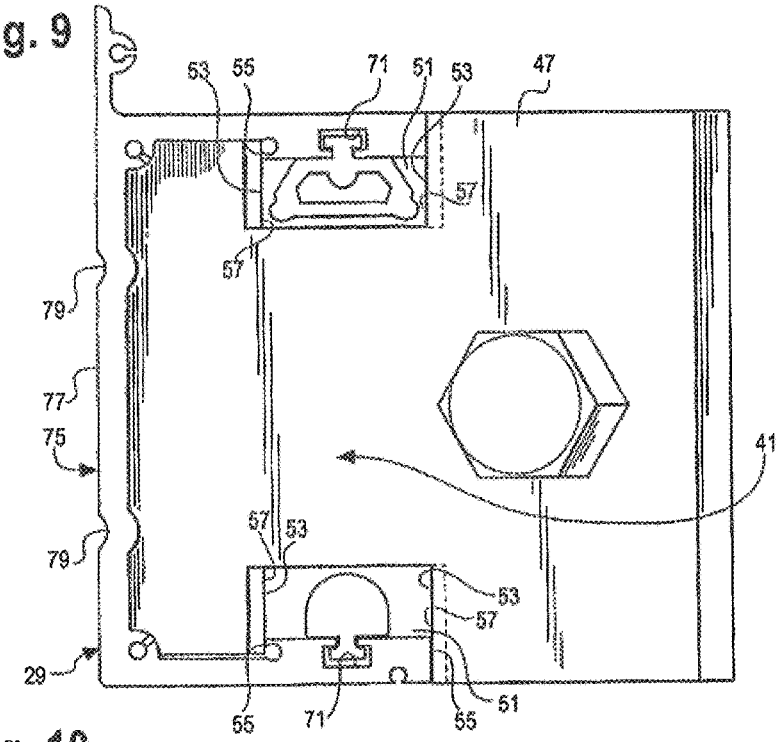
FIG. 9 is a top plan view of the components shown in FIG. 8.

Referring now to FIGS. 1-4 generally, and FIGS. 8 and 9 more particularly, a removable compression clamp 47 may be used in certain implementations in conjunction with one or more of the channels 41 to apply downward force or compressive force to at least the top-most panel 27 of the stack (FIGS. 1, 3) and therefore enhance the watertight seals formed between opposing panel edges of the stack. Compression clamp 47 has a clamp portion 49 configured to be received at a selected vertical location within channel 41.

In the implementation illustrated in FIGS. 8 and 9, clamp portion 49 is T-shaped and has a neck extending between opposing vertical gaskets 39 with a head portion extending further toward the back of channel 41 adjacent to the back wall thereof. The T-shaped formation of clamp portion 49 defines a pair of opposite slots 51 which extend vertically through compression clamp 47 and have slot walls 53 located adjacent to opposing bosses 55 formed on the opposing walls of channel 41. The relative size and spacing of slots 51 is such that slot walls 53 have edges 57 which engage bosses 55 in response to placement of compression clamp within channel 41 and tightening of compression clamp screw 59 downwardly to compress panel 27 (FIG. 8). As such, clamp portion 49 may assume a variety of configurations such that it has the ability to engage channel 41 at one or more locations in an interference fit in response to advancement of compression screw 49 against top edge of the top-most one of panels 27. Furthermore, in this implementation, compression clamp 47 may be inserted within channel 41 and positioned at any vertical location. Such arrangement affords not only flexibility to accommodate any stack height of the panels 27, but also fosters quick installation of the resulting stop log panel arrangement.

The components of flood barrier system 21, according to the present disclosure, may assume any of a variety of configurations suitable for protecting a corresponding variety of structures from inflow of flood water. Vertical elements 29, for example, may be designed for particular mounting positions relative to structures to be protected and to receive panels therein from corresponding directions or orientations. Certain exemplary configurations of vertical elements 29 and corresponding base plates 37 are shown not only in FIGS. 1-3, 5, and 6, but also in cross-section in FIGS. 15-22. One configuration of a vertical element 29 is a trap mount end track 75 (FIGS. 1-3, 5, 6, 21, and 22). Trap mount end track 75 is configured to be mounted against a wall extending generally orthogonally to the anticipated run of panels 27, and, in this implementation, is configured with a corresponding base plate 37 shown in FIG. 5. In this implementation, trap mount end track 75 includes a single channel 41 with sidewall structures configured to receive ends of panels 27 therein substantially orthogonally to the rear of channel 41 and generally parallel to arms of such channel 41.

Referring now to FIGS. 8, 9, rear surface 77 of end track 75 has one or more reliefs 79 formed therein. Reliefs 79 may be equipped with ribs or other engaging elements which, in turn, are brought into contact with suitable, opposing sealer elements to promote better adhesion between the rear surface 77 of trap mount end track 75 and the surface to which it is to be mounted.

Another variation of vertical element 29 is to configure the channel for receiving panels 27 therein to allow panels 27 to run generally parallel to the surface upon which vertical element 29 is mounted. One such configuration is wall mount end track 81 and its corresponding base plate 37 (FIGS. 1, 2, 19, 20).

While end tracks 75 and 81 are configured to be mounted to corresponding vertical surfaces of a structure to be protected, the present system 21 likewise includes vertical elements 29 which are intermediate to end tracks of the system. One or more of such intermediate vertical elements may be located between end tracks of the system. Such intermediate vertical elements may assume a variety of forms and will generally be referred to herein as stanchion posts. In one form, stanchion posts may be substantially secured to the structural foundation, footer or groundplane at their respective bottom ends, rather than to portions of the built-up structure and are thus adapted to withstand loads caused by floodwater received in a cantilever fashion. In one variation, a stanchion post may include an angled leg or bracket extending from an intermediate vertical location on the stanchion post downwardly toward the foundation at an angle. Such angled leg may terminate in a footer laterally spaced from the stanchion post and thereby provide support to such stanchion post against flood load. Stanchion posts may likewise be configured to be secured at the bottoms and span an opening sufficiently to be secured to a header or other raised location.

Figure 2:
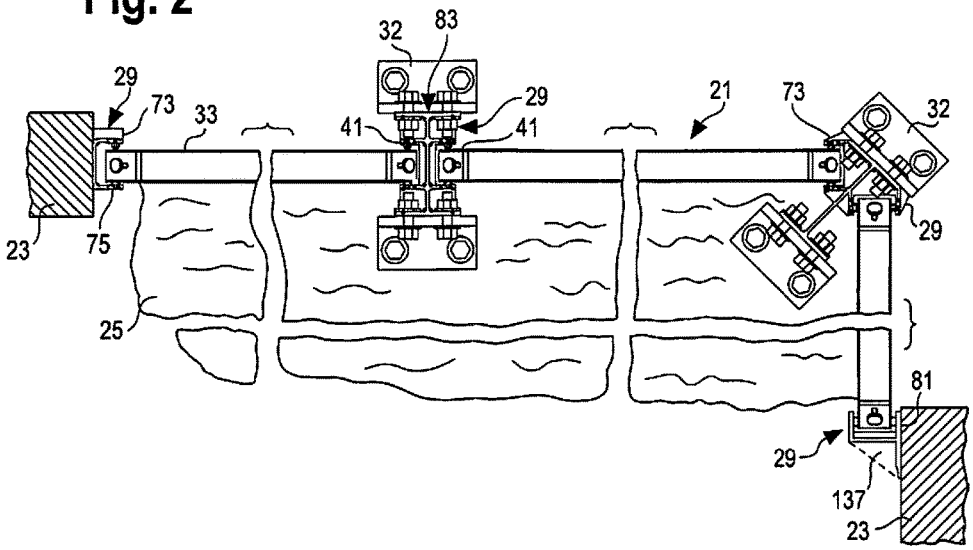
FIGS. 2, 3, and 4 are top, front, and side elevational views of the flood barrier system shown in FIG. 1.
Figure 16:
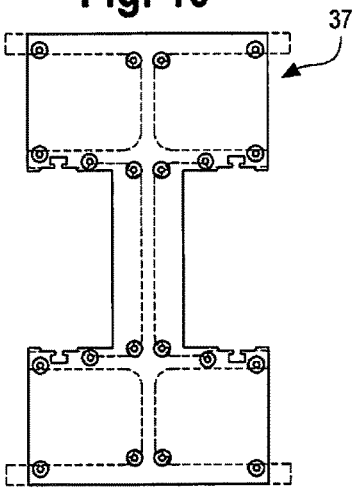
Figure 17:
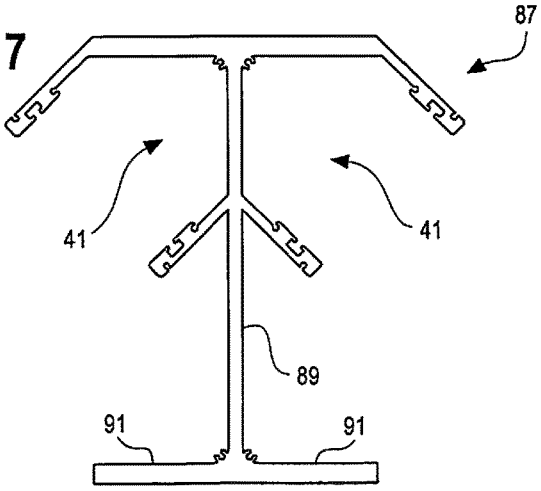

Referring now to FIGS. 1, 2, 3A, 15, and 16, one implementation of a stanchion post 83 is configured to include two of the channels 41 oriented one-hundred eighty degrees (180°) from each other. As such stanchion post 83 likewise receives corresponding ends of panels 27 into each of such channels 41 and thus allows for two stacks of the panels 27 to form a substantially planar wall as shown in FIGS. 1-3. Stanchion post 83 includes a correspondingly shaped base plate 37, as shown in FIGS. 3A and 16. Base plate 37 for stanchion post 83 may comprise a multi-layer or composite base plate as explained previously, including a structural plate sandwiched between upper and lower gaskets respectively, so that bottom end of stanchion post 83 may be secured to base plate 37 in a watertight manner and stanchion post, in turn, may be suitably secured to the ground with a corresponding, compressible gasket to promote a watertight seal between the ground and stanchion post 83.

Figure 18:
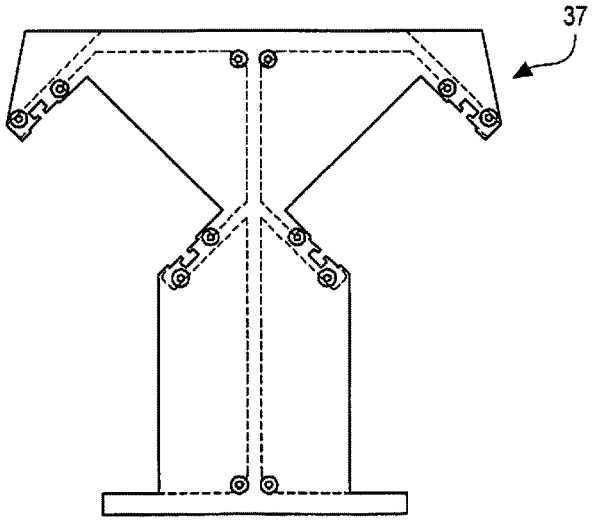
Figure 19:
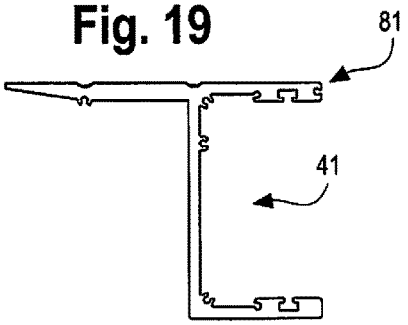
Figure 20:
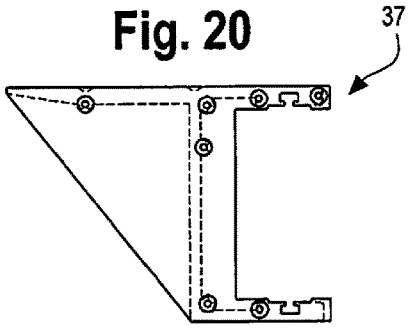
Figure 21:
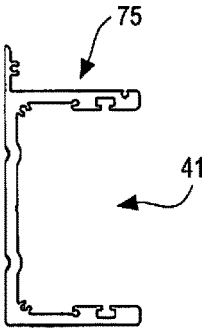
Figure 22:
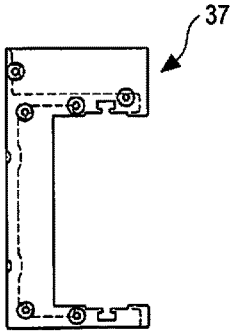

Other variations of stanchion posts are likewise contemplated, such as stanchion post 87 which orients the two channels 41 at a ninety degree angle (90°) from each other rather than the 180° angle of stanchion post 83. As shown in FIGS. 1 and 18, stanchion post 87 permits adjacent stacks of panels 27 to run at an approximate ninety degree angle from each other and thereby form a "corner" in the flood barrier system 21. Other stanchion post angles are likewise suitable and contemplated herein.

Stanchion posts 83, 87 may include one or more web portions 85 extending from one or more tracks or channels 41. In the illustrated implementation, stanchion post 83 includes a pair of the web portions 85, each extending transversely from corresponding sides of tracks or channels 41, and each of the outwardly extending web portions 85, in turn, include a pair of oppositely oriented flanges 91 located at the ends of respective webs 85. In the case of stanchion post 87, a single web portion 89 extends from the junction of the rear faces of channels 41 in a transverse direction and likewise terminates in two of the flanges 91. A suitable arrangement of web portions and flanges on stanchion posts increases the strength and stiffness of such stanchion posts against loads from the inflow of flood water.

As such, the above-described features of stanchion posts 83, 87, may be implemented by forming stanchion posts herein substantially of extruded aluminum. In certain implementations, stanchion posts 83, 87 are formed substantially of a single piece of extruded aluminum, including the aforementioned channels 41 and web portions and flanges illustrated. It is to be understood that gaskets, fasteners, and other subsidiary pieces may be added to stanchion posts of the present disclosure and that such posts will still be considered substantially formed of extruded aluminum or of a single piece of extruded aluminum, as the case may be, even when such additional components are added to such stanchion posts.

Figure 11:
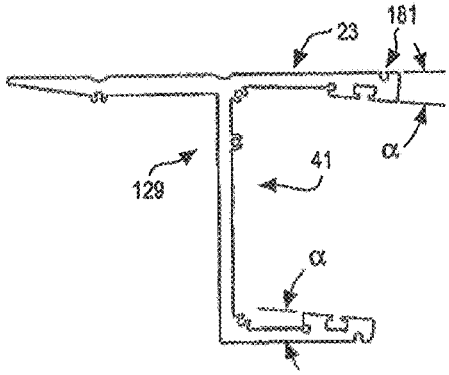
FIG. 11 is a top sectional view of a component useful in certain implementations of flood barriers according to the present disclosure.

Still other angular variations to the channels 41 in the vertical elements 29 are contemplated by the present disclosure. For example, certain applications may benefit from imparting an orientation to channel 41 and thus to panels 27 such that they extend from structure 23 at an acute angle $\alpha$, as shown by acute-angle wall-mount end track 181 shown in FIG. 11. Multiple vertical elements having corresponding, supplementary angles to acute angle $\alpha$ can likewise be used to receive opposite ends of panels received within acute angle track 181. Any number of angular variations to end tracks or stanchion posts may be configured, depending on design parameters or constraints of the application. In some embodiments, acute angle $\alpha$ may be selected to range from 2° to 15° in track 181, and many applications have found 4° to 8° values for a to be suitable, with a corresponding stanchion post to receive opposite ends of panels 27 received in acute angle track 181, such receiving stanchion post angling its channels 41 by a corresponding acute angle $\alpha$ (or its supplementary obtuse angle, depending on how one views it). The foregoing acute angle vertical elements 129 are suitable in many applications. For example, where an intermediate vertical element is to be placed at a location laterally spaced from the plane of the wall associated with an end track or other vertical element, the suitably angled channels may foster a more efficient layout of the system.

Figure 10:
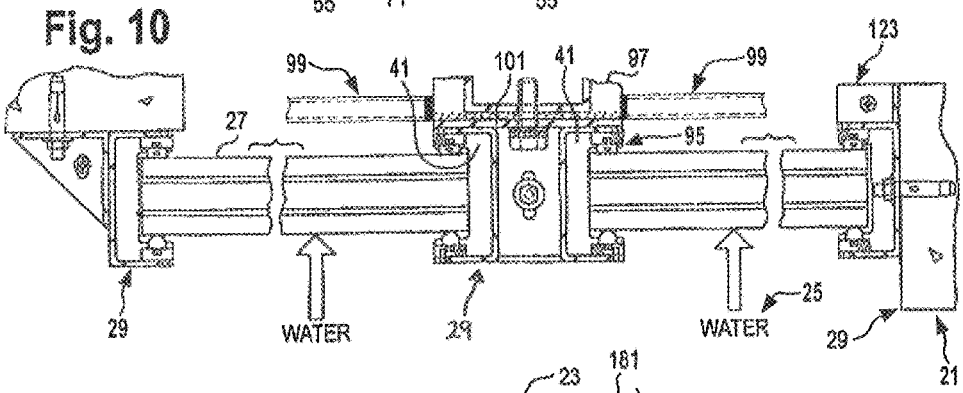
FIG. 10 is another implementation of a flood barrier system according to this disclosure.

In still another variation to vertical elements 29, a center mullion post 95 is adapted to be secured to a mullion 97 located between windows 99 of a structure 123, as shown in FIG. 10, to protect against inflow of flood water 25. Mullion post 95 includes a back mounting plate 101 adapted to be secured to mullion 97, and has portions defining a pair of oppositely oriented vertically extending tracks 41. Tracks 41 are located proximate to mounting plate 101 so as to position tracks 41 proximate to the planes of windows 99. In this way, when panels 27 are received in the tracks of mullion post 95, the tracks are oriented and positioned so that the faces of panels 27, and system 21 as a whole, remain proximate to windows 99 to be protected. Availability of such a mullion post may afford system 21 the advantage of reducing its horizontal footprint relative to the structure to be protected, which may be useful in situations where there are zoning, boundary, set-off, or similar horizontal space constraints, or where there is a need or desire to minimize the amount of footer/foundation in deploying system 21.

In one possible implementation of this disclosure, vertical elements 29 have pairs of vertical gaskets 39, one a so-called "wet side" gasket to oppose the forward face of the panels and the other a so-called "dry side" gasket to oppose the rearward face of the panels. The relative spacing of the wet side and dry side gaskets, or the overall gasket configurations themselves, may be selected, so that the flood barrier system 21 is of the "passive" type. In such passive implementations of the disclosure herein, after suitable vertical compression from any suitable vertical clamping arrangement, system 21 may be sufficiently watertight without requiring vertical panels to be manually urged or engaged horizontally against vertical gaskets. Although the disclosure herein contemplates such passive systems, the scope of this disclosure is not limited to merely passive systems. It will be appreciated that the disclosed system and its features are likewise useful in non-passive systems, and that the provision of additional means of securing the vertical panels beyond the vertical compression disclosed herein remains likewise within the scope of the present disclosure.

Figure 12:
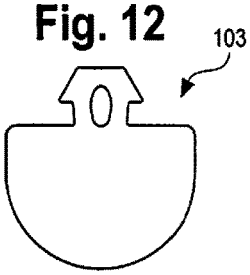
FIGS. 12-14 are cross-sectional views of gaskets useful in various implementations of the flood barrier system disclosed herein.
Figure 13:
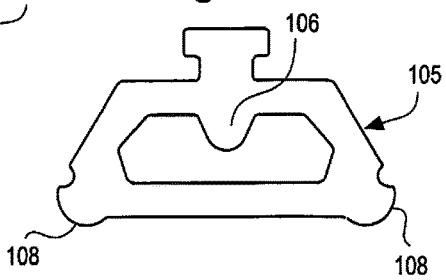
Figure 14:
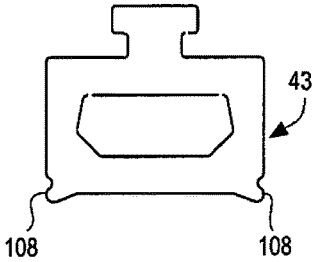
Figure 15:
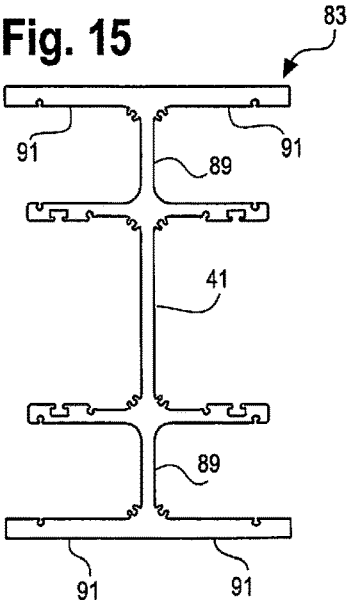
FIGS. 15-22 are cross-sections of various vertical elements and corresponding base plates in various possible implementations of flood barriers according to the present disclosure.

Referring now to FIGS. 12-14, certain implementations of system 21 may use wet side gaskets in the form of gasket 103 having a hemispherical cross section and corresponding surface for engaging the forward facing surfaces of panels 27 received in channels 41 of vertical elements 29. Opposite wet-side gasket 103 is dry-side gasket 105 shown in FIG. 13. Dry side gasket 105 includes a hollowed central portion within a trapezoidal cross section that compresses in response to the load of water to which it is exposed. Gasket 105 likewise includes a stop boss 106 within its hollowed central portion, as well as two beads 108 located at outer edges of gasket 105 and opposing rear faces 33 of opposing panels 27 (shown at corners in the cross section). Beads 108 may extend vertically over the length of the gasket itself. The provision of the above-described features causes beads 108 to be urged against the rear panel surfaces 33 when dry side gasket 105 is compressed, thereby enhancing watertight sealing in the two discrete locations corresponding to beads 108 and corresponding locations on the opposing panel surfaces 33.

In one possible implementation, the spacing of wet side and dry side gaskets relative to each other and relative to panels inserted therebetween is such that a watertight seal is formed by both wet side and dry side gaskets upon deployment. Upon sufficient loading caused by sufficient flood water on the forward faces of panels 27, it is within the intended operational parameters of system 21 to permit water to pass through the seal formed between wet side gasket 103 and the forward faces of the panels 27. An increase in floodwater load which may cause water to pass wet-side gasket 103 likewise may further compress dry-side gasket 105 and its dual beads 108 into increased contact with opposing rearward faces of panels 27. So, regardless of whether water may pass wet side gasket 103 and may go through panels 27, such water is nonetheless substantially prevented from passing dry side gaskets 105 and thus flood barrier system 21 protects the structure.

A pair of the panel gaskets 43 is mounted to extend horizontally along bottom edges of panels 27, as discussed previously with reference to FIG. 3A. Referring now to FIG.

14, panel gasket 43 is shown in cross section, and includes two beads 108 as well, along with a compressible inner region. Beads 108 on panel gaskets 110 likewise form two watertight seals to protect against passage of water between opposing edges of panels 27 stacked atop each other in system 21.

Figure 7:
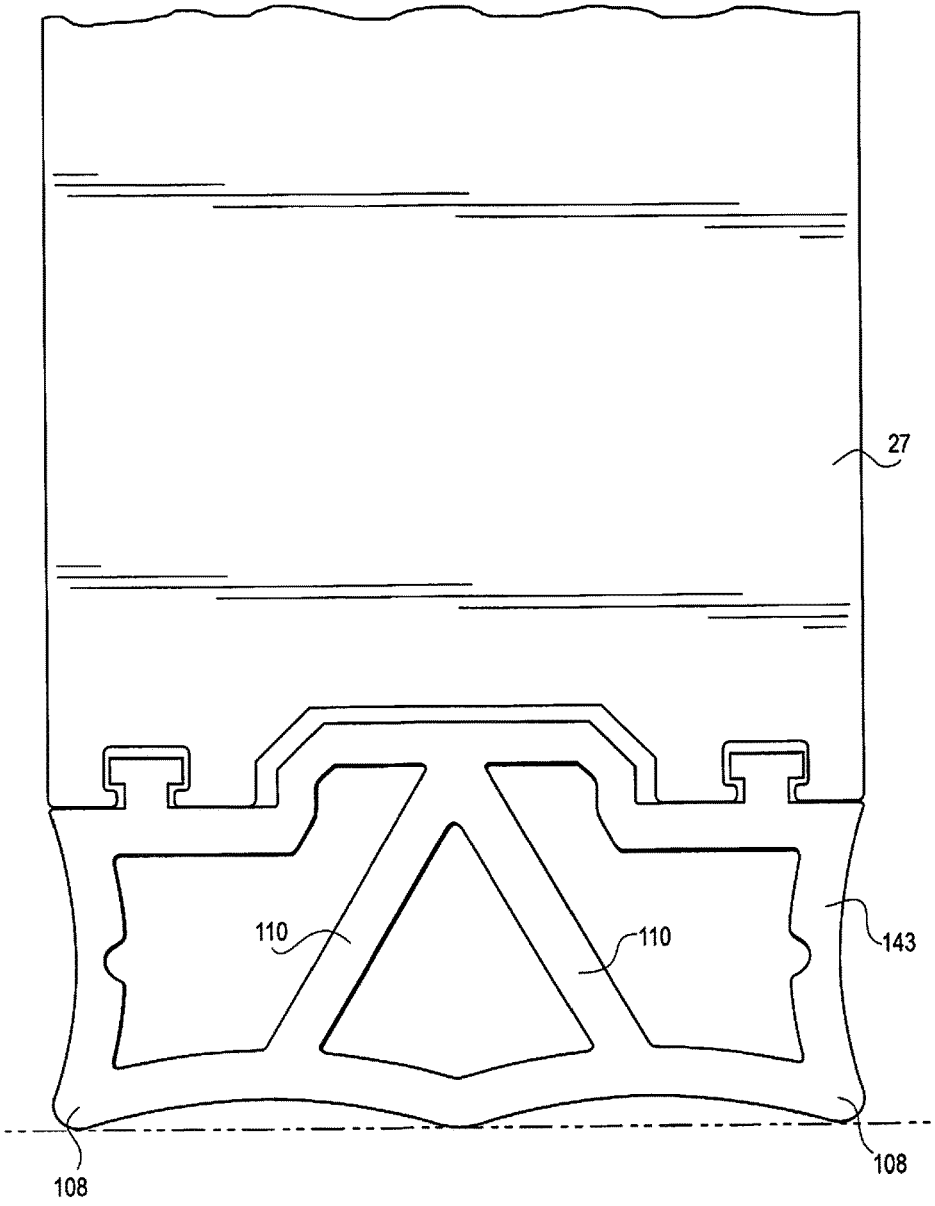
FIG. 7 is an enlarged sectional view of a panel member suitable for use as part of an implementation.

Referring now to FIG. 7, panel gasket 143 optionally may be used on bottom-most ones of the panels 27, or otherwise as an alternative to the pair of gaskets 43 described above. Panel gasket 143 has features which allow for a greater range of compression between the bottommost portion of gasket 143 and the bottom edge of panel 27. As such, when panel gasket 143 is used on the bottom-most one of the panels 27 in a panel stack, the beads 108, struts 110, and hollowed portions 112 as arranged in FIG. 7 permit variations in the height of the ground to be better accommodated without compromising the watertight integrity of the seal between the bottommost one of panels 27 and the opposing surface of the ground. Any number of additional variations to gaskets 43, 143 are suitable, depending on the associated application. Similarly gaskets 43, 143 may be mounted to top edges or any number of alternate locations on panels 27. Top and bottom edges may likewise assume a variety of shapes, which, in turn may affect the need for gaskets at all, as well as their shape and location.

The dimensions, materials, alloys, durometers, and other characteristics of the components of flood barrier system 21 may be varied, depending upon the particular application contemplated, including the size or configurations of the flood barrier system 21, the nature, location, and other physical characteristics of the structure, including its foundation and elements to be protected, and the nature of flood waters anticipated or to be protected against.

System 21 illustrated herein represents one possible implementation, balancing the factors of functionality (such as flood resistance, ease of assembly), weight, and cost, and designed to resist between 1 to 6 feet of flood water. Such system may include vertical elements 29 formed of extruded aluminum having the characteristics of 6005A-T61 alloy. Base plates 37 underlying its vertical elements are formed of three layers, the structural plate 65 being preferably formed of 6063-T6 aluminum alloy, the upper base plate gasket 63 comprising EPDM with a 40 durometer; the lower base plate gasket 67 comprising EPDM with a 40 durometer.

Among the suitable configurations for vertical gaskets 39 for gasket 21 in this implementation, "wet" side gasket 103 has a durometer of 70, is formed of polymeric material including ASTM D2000 M4AA708 A13 B13 Z 70 durometer black dense EPDM, and has an uncompressed height of about 0.422" for the gasket body plus 0.15" for the T-component with zero anticipated nominal compression under average flood water conditions. Dry side gasket 105 is formed of a polymeric material including ASTM D2000 M3 BA510 A14 B13 50 durometer black sulfur-cured EPDM, having a distance of 0.983" out to out of the vertical extending beads 108, with hollowed portion selected so that gasket compression has been arranged from 0% to 35% when the blade is inserted and up to 65% under flood loads.

Vertical elements 29 in the illustrated implementation may be formed substantially of a single piece of extruded aluminum, such as 6005A-T61 alloy. It will be appreciated that vertical elements 29 may have structural elements formed of aluminum, and sealing elements of non-metal material, such as gaskets. Webs 89 may extend from channels 41 orthogonally to the plane of the panels to structurally connect a 5" wide flange on each end of the web with flange to flange, out to out dimension of 8".

Stanchion post 83 is designed so that, when secured to the ground, it can withstand horizontal loads consistent with wind and water loading requirements with bolted connections that do not interfere with the panels engagement in channel 41.

Panels 27 are, in certain implementations, formed of aluminum and have overall dimensions of 2.5" wide by 12.25" high. The horizontal span of panels 27 may assume a variety of values. In a system designed to resist between 1 to 6 feet of flood water, panels ranging between 2 feet to 12 feet in span have been found to offer a good balance of weight, cost, and functionality for system 21. But, again, other spans or panels dimensions and configurations are within the present scope. Gaskets 43 on bottom edges of panels 27 have a durometer of 50, with anticipated compression from the uncompressed state of 0.425" for the gasket body plus 0.15" for the T-component to a compressed state of 0.212" for the gasket body. Bottom gasket 143 has the following characteristics in certain implementations: ASTM D2000 M3 BA510 50 durometer black sulfur-cured EPDM material with an overall width of 2.502" and an overall height of 1.25".

Still further variations are within the present scope, and may depend on factors as diverse as building codes, flood protection desired (50-year or 500-year flooding), and relative importance of functionality versus weight, portability, and overall budget.

Having described the structure and features of various implementations of flood barrier system 21, its deployment can be readily appreciated. After assessing structure 23 to be protected against floodwater, and attending to any advance preparation to its foundation, footers, walls, and the like, system 21 suitable for the particular structure is designed, including an arrangement of panels and vertical elements. Vertical elements 29 can be drawn from any of the exemplary vertical elements 29 disclosed herein and variations thereof, whether serving as end tracks, stanchion posts, mullion posts, or any of the variety of vertical elements needed to engage ends of panels 27 for the particular application. Vertical elements 29 are suitably secured to the horizontal, whether ground-plane, footer, or foundation relative to structure 23, or to structural walls or mullions, as the particular design may require.

In the case of securing elements 29 to the horizontal plane, L-brackets 32 or any alternative suitable securing means are used proximate to the structure. In the event one or more of the vertical elements 29 includes a base plate 37, base plate 37 has its bottom surface opposing the ground or foundation. If the bottom surface of base plate 37 includes a lower base plate gasket 67, such element 29 is secured in such a way as to suitably compress such base plate gasket 67 to promote a watertight seal between the base plate and the opposing surface of the foundation or ground.

In the case of wall mount end tracks or mullion posts, such vertical elements are suitably secured to appropriate locations on the walls of the structures or mullions thereof.

During installation, panels 27 are stacked atop each other and extend in courses between opposing tracks 41 of vertical elements 29. Once the panels 27 are stacked to the desired height in channels 41 of vertical elements 29, compression clamp 45 may be positioned at a vertical location in channels 41 above the top edge of the topmost panel 27. Compression clamp screw 48 is suitably advanced toward the topmost edge of the top panel 27, engages such edge, and at a certain point has clamp portions 49 engaging corresponding locations on channel 41 to provide resistance to the clamping force and vertical compression to the stack of panels 27.

Upon installation of panels 27 in channels 41 and suitable application of vertical compressive force both to the bottoms of vertical element 29 and to the tops of stacks of panels 27, a flood barrier wall has been deployed for protecting corresponding structure 23 from the inflow of flood water 25.

In the illustrated implementations, ends of panels 27 are inserted into channels 41 between vertical gaskets 39. The spacing is such that panels 27 have either rearward faces 33, forward faces 31, or both, in contact with corresponding vertical gaskets. If system 21 includes gaskets with two or more parallel, vertically extending beads, such as 108, a pair of seals are formed on the dry side of system 21, further enhancing the water protection attributes of system 21. Either upon insertion of panels 27 within channels 41, or upon exposure of structure 21 to the loads caused by flood waters, gaskets 39 seal against opposing surfaces of panels 27 in a watertight manner, either on the "dry-side" gasket side, the forward "wet side," or both.

Additional operations to seal panels 27 relative to vertical elements 29 or to structure 23 may be performed within the scope of the present system 21 and corresponding disclosure. For example, manual operations to seal rearward faces 33 of panels 27 against dry side gaskets of elements 29 may be performed in to certain implementations.

The arrangements of vertical gaskets 39 relative to other system components disclosed herein, including the interference fit or fusing of gasket bottom portions to base plate 37, the features of panels 27 and panel gaskets 43, 143 relative to vertical gaskets 39 or the ground-plane disclosed herein, and the other advantages apparent from the foregoing description promote sealing critical areas of system 21 in a watertight manner and thereby reduce passage of water therethrough, or other undesirable leaks of water toward structure 23.

It will be appreciated that when phrases "watertight," "in a watertight manner" or similar phrases are used in describing features or components of system 21, such phrases shall mean not only that the corresponding structure forms a barrier stopping one hundred percent of the water and completely free of leaks therethrough, but such terms likewise are intended to encompass that the seals and structures are substantially waterproof, substantially watertight, and substantially leak free, as protection afforded by system 21 herein to a structure against inflow of water shall be considered effective and water-tight even if not always at one hundred percent, and even if there is a certain amount of leakage through flood barrier system 21. Accordingly, it will be appreciated that the disclosure and claims herein, when referring to "watertight" or "in a watertight manner," are intended to encompass the situation where system 21 substantially prevents flood water from passing therethrough, and thus a watertight seal may exhibit some leaking either at the outset or over time and still be considered within the scope of this disclosure and the corresponding claims to sealing in a watertight manner.

Having described various implementations and variations of the flood barrier system set out herein, it will be appreciated that still further alternatives are likewise within the scope of the present disclosure and encompassed by the claims appended hereto, as are equivalents thereof.

What is claimed is:

1. A flood barrier system for protecting a structure from the inflow of flood water, the structure having coplanar windows and at least one mullion located between the windows, the system having stackable stop-log panels deployable in response to flood or flood risk to form a temporary barrier to the flood water, the panels having forward faces oriented toward the flood water and rear faces opposite the forward faces, the system comprising:

multiple vertical elements, at least one of the vertical elements including a back mounting plate adapted to be securable to the mullion, the vertical element having a pair of vertically extending tracks having back walls formed by the mounting plate to position the tracks proximate to the plane of the windows, the tracks sized to receive ends of the panels;

wherein at least one of the vertical elements has a first wet-side gasket and a second, dry-side gasket, each gasket extending vertically along the vertical element, the wet-side gasket opposing the forward faces of the panels and the dry-side gasket opposing the rear faces of the panels, the wet-side and dry-side gaskets being spaced from each other and configured to engage the panels in a water-tight manner upon placement of the panels between the first and second gaskets and to permit the panels to be shifted rearwardly upon exposure to predetermined loads caused by flood waters;

wherein the tracks are oriented to position the panel faces proximate to the windows to be protected.

2. The system of claim 1, wherein, at least one of the vertical elements includes three walls defining a vertically extending channel;

wherein the system further comprises a removable compression clamp, a compression screw moveably mounted to the compression clamp, and a top-most one of the panels received within the vertically extending channel;

wherein the compression clamp has clamp portions configured to be received at a selected vertical location within the channel; and wherein the clamp portions are configured to engage the channel in response to advancement of the compression screw against the top edge of the top-most panel.

3. The system of claim 1, wherein at least one panel gasket is mounted to one of the edges of the panels and configured to remain substantially between the opposite faces of the panel upon vertical compression of the panels associated with the deployment of the flood barrier system.

4. The system of claim 1, wherein at least one of the vertical elements includes:

a back mounting plate extending vertically and adapted to be secured substantially flush with an opposing surface of the structure on a corresponding vertical plane; and portions defining a vertically-extending track oriented at an acute angle to the vertical plane, the track receiving the panels therein to cause the panels to extend away from the vertical plane at an angle corresponding to the acute angle.

5. The system of claim 1, wherein the at least one vertical element has structural elements and sealing elements, wherein the structural elements are formed substantially of extruded aluminum.

6. The system of claim 1, wherein the vertical element adapted to be secured to the mullion comprises a first vertical element;

wherein the multiple vertical elements comprise second and third vertical elements adapted to be secured relative to the structure at laterally spaced locations to each side of the first vertical element;

wherein the tracks of the first, second, and third vertical element have forward walls defining a forwardmost plane relative to the plane of the windows; and wherein the first, second and third vertical elements are secured relative to the windows at locations within the forwardmost plane, thereby occupying a horizontal footprint between the structure and the forwardmost plane.

7. A flood barrier system for protecting a structure from the inflow of flood water, the structure having coplanar windows and at least one mullion located between the windows, the system having stackable stop-log panels deployable in response to flood or flood risk to form a temporary barrier to the flood water, the panels having forward faces oriented toward the flood water and rear faces opposite the forward faces, the system comprising:

multiple vertical elements, at least one of the vertical elements including a back mounting plate adapted to be securable to the mullion, the vertical element having a pair of vertically extending tracks having back walls formed by the mounting plate to position the tracks proximate to the plane of the windows, the tracks sized to receive ends of the panels;

wherein at least one of the vertical elements has a first wet-side gasket and a second, dry-side gasket, each gasket extending vertically along the vertical element, the wet-side gasket opposing the forward faces of the panels and the dry-side gasket opposing the rear faces of the panels, the wet-side and dry-side gaskets being spaced from each other and configured to engage the panels in a water-tight manner upon placement of the panels between the first and second gaskets and to permit the panels to be shifted rearwardly upon exposure to predetermined loads caused by flood waters;

wherein the tracks are oriented to position the panel faces proximate to the windows to be protected;

wherein the vertical element adapted to be secured to the mullion comprises a first vertical element;

wherein the multiple vertical elements comprise second and third vertical elements adapted to be secured relative to the structure at laterally spaced locations to each side of the first vertical element;

wherein the tracks of the first, second, and third vertical element have forward walls defining a forwardmost plane relative to the plane of the windows; and wherein the first, second and third vertical elements are secured relative to the windows at locations within the forwardmost plane, thereby occupying a horizontal footprint between the structure and the forwardmost plane;

wherein the stackable stop-log panels comprise at least one panel adapted to be a bottommost panel of a corresponding stack, the bottommost panel having a bottom edge;

wherein the first, second, and third vertical elements have vertically oriented tracks adapted to extend substantially to ground adjacent to the structure to be protected, the ground characterized by a substantially planar ground plane and variations therefrom, the vertically oriented tracks comprising at least one pair of opposing, laterally spaced tracks adapted to receive therebetween the bottommost panel;

wherein the bottommost panel has at least one bottom gasket extending over a length along the bottom edge;

wherein the bottom gasket comprises a pair of struts extending along the bottom edge of the panel, the struts extending downwardly from the bottom edge by an amount sufficient to accommodate variations of the ground plane and terminating in a pair of beads adapted to contact the ground when the bottommost panel is deployed; and wherein, in response to downward compressive force on the bottommost panel when deployed, the struts collapse and the location of the beads relative to the bottom edge of the bottommost panel varies along the length of the bottom gasket to maintain a watertight seal at locations corresponding to variations in the bottom plane.

8. The system of claim 7, wherein the bottommost panel has two of the bottom gaskets, one extending along the bottom edge adjacent the forward face of the bottommost panel, the other extending along the bottom edge adjacent the rear face of the bottommost panel.

9. The system of claim 7, wherein, at least one of the vertical elements includes three walls defining a vertically extending channel;

wherein the system further comprises a removable compression clamp, a compression screw moveably mounted to the compression clamp, and a top-most one of the panels received within the vertically extending channel;

wherein the compression clamp has clamp portions configured to be received at a selected vertical location within the channel; and wherein the clamp portions are configured to engage the channel in response to advancement of the compression screw against the top edge of the top-most panel.

10. The system of claim 7, wherein at least one panel gasket is mounted to one of the edges of the panels and configured to remain substantially between the opposite faces of the panel upon vertical compression of the panels associated with the deployment of the flood barrier system.

11. The system of claim 7, wherein at least one of the vertical elements includes:

a back mounting plate extending vertically and adapted to be secured substantially flush with an opposing surface of the structure on a corresponding vertical plane; and portions defining a vertically-extending track oriented at an acute angle to the vertical plane, the track receiving the panels therein to cause the panels to extend away from the vertical plane at an angle corresponding to the acute angle.

12. The system of claim 7, wherein the at least one vertical element has structural elements and sealing elements, wherein the structural elements are formed substantially of extruded aluminum.

* * * * *